United States Patent [19]

Hoxsie et al.

[11] 4,383,432

[45] May 17, 1983

[54] CLOCK ESCAPEMENT MONITOR

[76] Inventors: Nein T. Hoxsie, 3949 - 5th Ave., San Diego, Calif. 92103; Eric J. Whitesell, 11651 Papagallo Ct., San Diego, Calif. 92124

[21] Appl. No.: 262,402

[22] Filed: May 11, 1981

[51] Int. Cl.[3] ..... G04B 17/00

[52] U.S. Cl. ..... 73/6

[58] Field of Search ..... 73/6

[56] References Cited

U.S. PATENT DOCUMENTS

| | | | |
|---|---|---|---|
| 2,784,586 | 3/1957 | Campbell | 73/6 |
| 3,238,764 | 3/1966 | Greiner | 73/6 |
| 3,805,585 | 4/1974 | Palinkas | 73/6 |
| 3,811,314 | 5/1974 | Anouchi | 73/6 |
| 3,946,592 | 3/1976 | Ichikawa et al. | 73/6 |
| 4,014,205 | 3/1977 | Wells et al. . | |

*Primary Examiner*—S. Clement Swisher
*Attorney, Agent, or Firm*—Frank D. Gilliam

[57] ABSTRACT

A clock escapement monitoring device and method of accurately adjusting the escapement. The device comprises a sensor for monitoring the mechanical vibrations occurring at each excursion and producing an electrical pulse representative thereof; a standard clock of 100K Hertz; a signal conditioning circuit for conditioning the electrical excursion pulses and providing an audio output for monitoring audio signals representative of the mechanical vibrations; two frequency dividing trains, one for the conditioned excursion pulses and the other for the standard clock signal; and a display counter connected to the outputs of the frequency dividing trains wherein a visual display is produced representing the time of one excursion interval, the average time of ten excursion intervals, and the average time of one hundred excursion intervals; a regulated power supply; and a visual monitor for indicating a low power supply voltage.

11 Claims, 4 Drawing Figures

CLOCK ESCAPEMENT MONITOR

BACKGROUND OF THE INVENTION

This invention is directed to measuring the escapement rate of time pieces and more specifically to using the information during the monitoring to synchronizing that time piece to its correct time period between excursions.

When a time piece having an escapement mechanism is overhauled, repaired, newly assembled, etc., the escapement must be regulated through adjustments to achieve the potential accuracy of the time piece. Several days are generally required in the process of observing the effect of each adjustment, correcting for the observed error and repeating the observation and adjustment until the time piece's potential is achieved. Although expensive devices exist to determine the escapement rate of small watches, no satisfactory device exists to perform this function for larger clocks having mechanical or electromechanical escapement mechanisms.

There has not been a satisfactory clock escapement monitor or method for positive accurate clock escapement adjustment until the emergence of the instant invention.

SUMMARY OF THE INVENTION

The monitoring device of this invention is capable of measuring and monitoring very accurately the excursions of the mechanical or electromechanical escapement mechanism of a time piece and producing a visual presentation of the time span between a single excursion or the average of multiple excursions. The device is specifically adjustable to read the time period between single excursions or the average of ten or one hundred excursion cycles. The indications have an accuracy of one part in ten thousand. An audio monitor is provided to listen to the escapement for the purpose of trouble shooting or for adjusting the sensitivity of the device so that only the actual excursions are detected, thus eliminating mechanical vibrations incidental to the escapement mechanism.

It is an object of this invention to decrease the time in which the escapement mechanism of a clock can be accurately adjusted.

It is an object of this invention to utilize the mechanical vibrations produced by the excursions of escapement mechanisms to measure the escapement cycle with a precision of one part in ten thousand.

It is an object of this invention to measure single beats of the escapement cycle and to average ensembles of ten and one hundred beats to smooth out the individual variations due to mechanical inaccuracies in order to facilitate the accurate regulation of escapement mechanisms.

Another object of this invention is to monitor the performance of escapement mechanisms by displaying the minute variations between excursions as an aid in diagnosing problems of a nature too subtle to detect from a general inspection of the actual mechanism.

Another object of the invention is to audibly monitor the performance of the escapement cycle for trouble shooting and for adjusting the sensor detection threshold so as to discriminate against other mechanical vibrations incidental to the escapement cycle and to provide a uniform triggering level from one cycle to the next.

Still another object of the invention is to provide a means of ignoring mechanical vibrations for a predetermined time following each excursion.

These and other objects and advantages of the invention will become better understood by reference to the following detailed description when considered with the drawings, in which:

DETAILED DESCRIPTION OF THE PREFERRED EMBODIMENT

Figure 1:
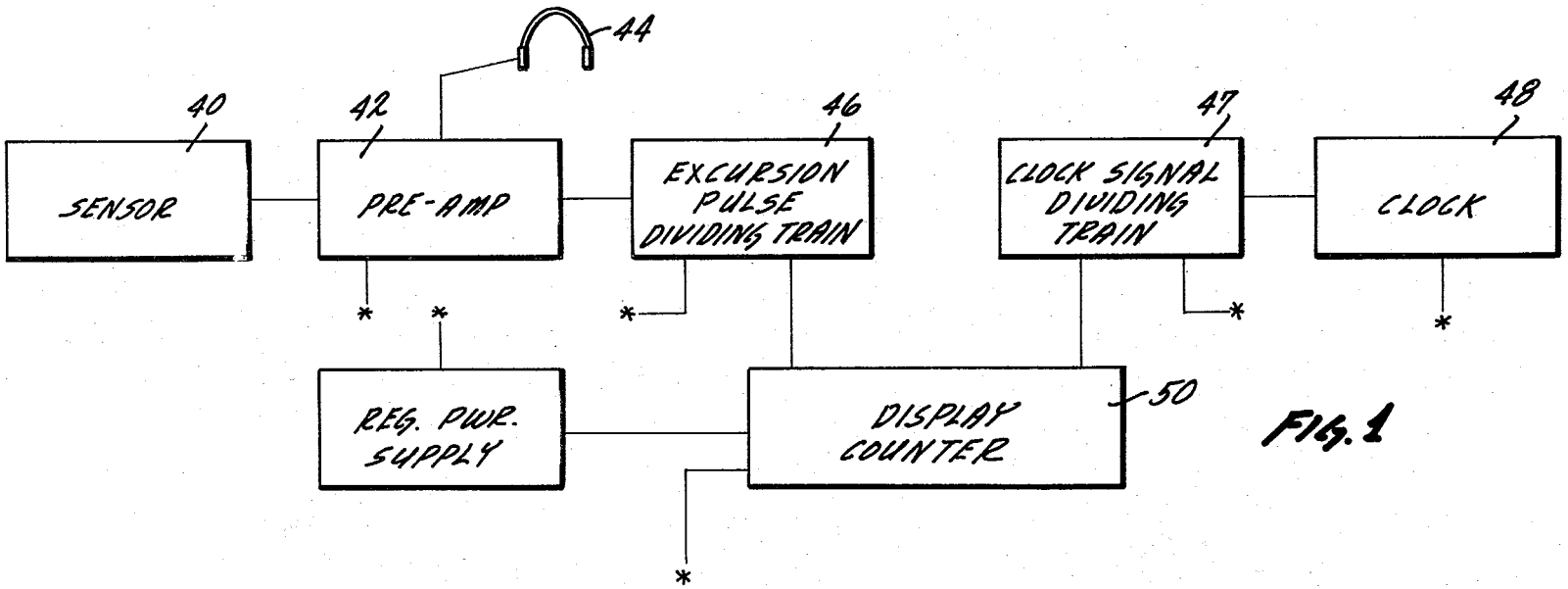
FIG. 1 is a block showing of the electronic circuits of the instant invention.

Referring now specifically to FIG. 1, a block diagram of the escapement monitoring device of the instant invention is shown. An audio sensor 40 is utilized to detect the vibrations occurring at each excursion of an escapement mechanism. The sensor 40 may take many different forms; by way of example, a piezoelectric device, a magnetic device, an optical device, an electromechanical transducer or the like. The only limitation as to the type of sensor is that the device be capable of detecting the excursion limits (ticks) of the escapement mechanism to produce an electrical signal relating thereto. The electrical signal output of the sensor provides an input to a preamplifier circuit 42. The preamplifier circuit 42 provides means for monitoring the amplified sensor signals through a convenient audio listening means 44, such as but not limited to headphones, speakers, or the like. A second output from the preamplifier 42 provides an input to a pulse dividing train 46. An input to the clock dividing circuit 46 is provided from a standard clock 48. The standard clock 48 is utilized to provide a precise timing reference to the clock dividing circuit 47. Count pulses are separately fed from the two dividing trains to the display counter and controller circuit 50. The digital readout portion of display counter 50 provides the operator of the device with a visual indication of the period between excursions of the escapement mechanism. A regulated power supply 52 is provided to provide the appropriate voltage level to operate the electronic components within the blocks of the block diagram showing. The regulated power supply and low voltage circuit 52 further controls the output of the pulse dividing train 46 and the clock dividing train 47. When the power supply voltage drops below a preselected level the low voltage circuit outputs a signal to the display portion of the display counter circuit 50 and the digital readout is terminated to prevent the operator from getting spurious readings.

Figure 2:
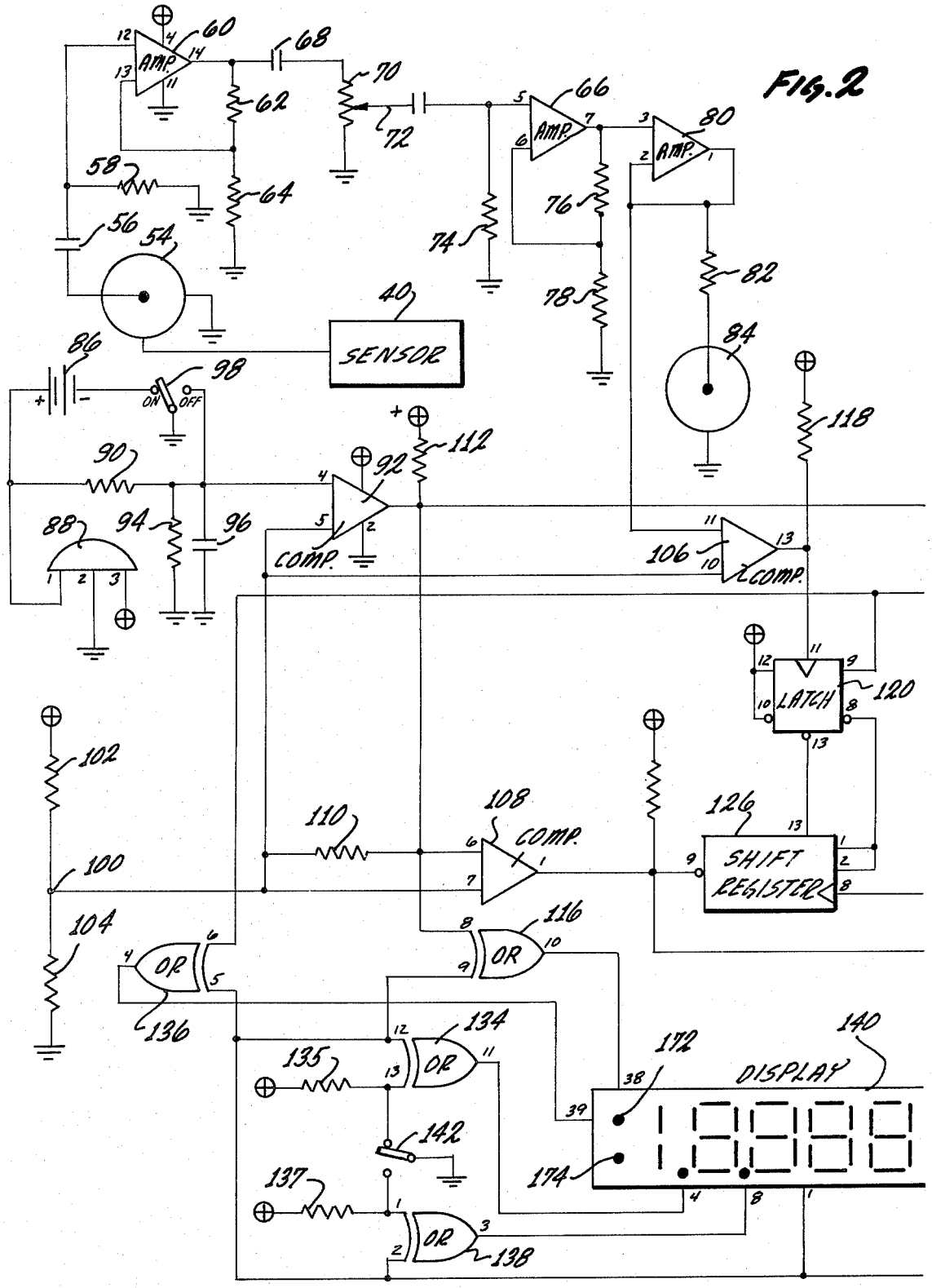
FIG. 2 is a partial detailed schematic diagram of the circuitry of FIG. 1.
Figure 3:
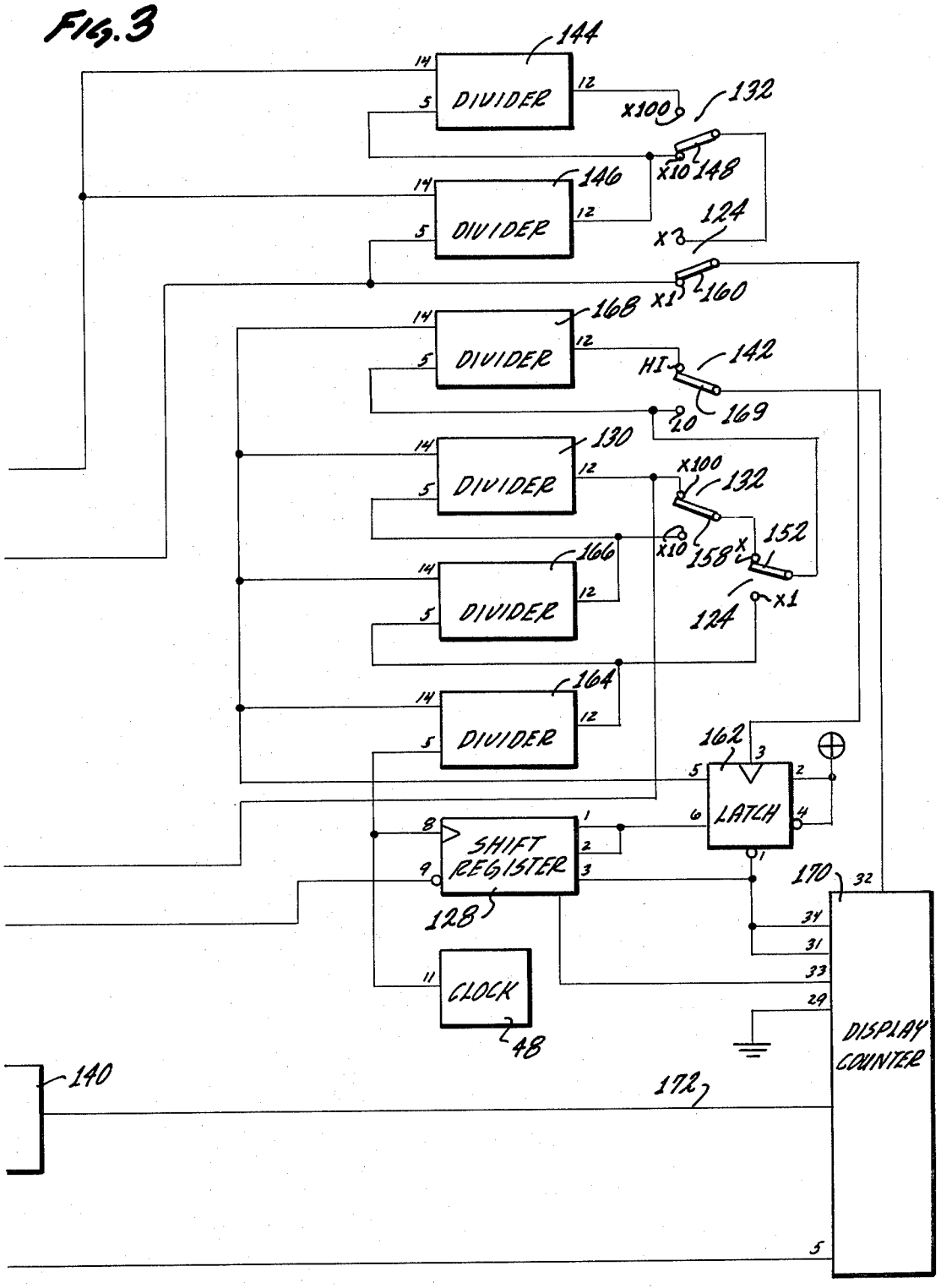
FIG. 3 is a second portion of the detailed schematic of the block diagram of FIG. 1.

Referring now to FIG. 2, a phone jack 54 is shown for receiving the input from the sensor 40. Any type of jack may be used, such as but not limited to a phone jack or the like. The sensor input from the jack 54 fed to the preamplifier circuit through a 0.01 microfarad capacitor 56 which takes two paths. One path is shunted to ground through a 1 meg ohm resistor 58 and the other provides an input to terminal 12 of an operational amplifier 60. The output from terminal 14 of the operational amplifier 60 is fed back to its input terminal 13 through a 100K ohm resistor 62. The common point between the 100K ohm resistor and the input to terminal 13 of the operational amplifier 60 is also tied through a 1K ohm resistor 64 to ground. The junction at terminal 14 of the operational amplifier 60 and the 100K ohm resistor is connected to the input terminal 5 of a second operational amplifier 66 through a 0.1 microfarad capacitor 68 which is connected to one electrical end of a 10K ohm linear taper potentiometer 70. The opposite end of the linear taper potentiometer 70 is connected to ground potential. The wiper 72 of the linear taper potentiometer 70 is fed through a 0.01 microfarad capacitor 44 to terminal 5 of operational amplifier 66. This input to operational amplifier 66 is also fed through a 100K ohm resistor 74 to ground potentional. The output terminal 7 of operational amplifier 66 is fed through a 100K ohm resistor 76 and a 1K ohm 78 respectively in series to ground potential. The common connection between the resistors 76, 78 connect the negative input terminal 6 of operational amplifier 66. The output terminal 7 of operational amplifier 66 also provides an input to terminal 3 of operational amplifier 80. The output terminal 1 of operational amplifier 80 is tied directly to its positive input and also through a 1,000 ohm resistor 82 to a convenience jack 84 used to attach the external earphone or speaker 44 so the operator can monitor the escapement mechanism by listening to the ticks. It should also be noted that each operational amplifier receives operating voltage from the regulated power supply 52.

Referring now to the regulated power supply 52 of the detailed embodiment. There is shown a 9 volt DC battery 86. The positive terminal of the battery is connected to the input terminal 1 of the regulated power module 88. This positive potential is also connected through a 1 meg ohm resistor 90 to the input terminal 4 of a comparator 92. Terminal 2 of the power supply module 88 is connected to ground potential and the regulated output voltage is provided at terminal 3. The input terminal 4 of this comparator 92 is also shunted to ground potential through a 510K ohm resistor 94 and 0.1 microfarad capacitor 96. The negative potential of the 9 volt battery 86 is connected to the "ON" terminal of switch 98 which is of the single pole double throw variety. The input to terminal 5 of comparator 92 is supplied from the regulated power supply 52 from the center terminal 100 of a voltage divider network utilizing a pair of 10K ohm resistors 102 and 104. Resistor 102 is connected to the regulated power supply output and resistor 104 is connected to ground potential. This input to comparator 92 from terminal 100 further provides an input to terminal 10 of comparator 106 and provides an input to terminal 6 of comparator 108 through a 1 megohm resistor 110 and also provides an input to terminal 7 of comparator 108. Terminal 6 of comparator 108 is also connected to terminal 2 of comparator 92. Terminal 2 of comparator 92 and terminal 1 of comparator 108 are connected through a 100K ohm resistor 112, 114 respectively to the output of regulated power supply 52. The input to terminal 6 through the 1 megohm resistor to comparator 108 is also connected to terminal 8 one of an exclusive "OR" gate 116.

The output from terminal 13 of comparator 106 is also connected through a 100K ohm resistor 118 to the regulated power supply 52. Terminal 13 of comparator 106 is also connected to input terminal 11 of latch 120. The output from terminal 9 of latch 120 is representative of the actual escapement excursion time period. The output from terminal 9 of latch 120 supplies an input to terminal 5 of divider circuit 122 and also provides one connection to the "X1" terminal of switch 124. Switch 124 is of the double pole double throw type. Terminals 10 and 12 of latch 120 are connected to the output of the DC regulated voltage. Output 8 of latch 120 provides an input to terminals 1 and 2 of shift register 126. Output from terminal 13 of shift register 126 provides an input signal to terminal 13 of latch 120 for clearing or resetting. The output from terminal 1 of comparator 108 is connected to terminal 9 of both shift registers 126 and 128 and provides a reset signal to both shift registers. The clock pulse from terminal 12 of divider 130 provides an input signal to terminal 8 of shift register 126 and also to the "X100" terminal of switch number 132 also of the double pole double throw type.

Connection 9 of exclusive "OR" gate 116 is connected to input terminal number 12 of exclusive "OR" gate 134. Terminal 12 of exclusive "OR" gate 134 is also tied to terminal 5 of exclusive "OR" gate 136, to terminal 2 of exclusive "OR" gate 138, to terminal 5 of the display counter 170, and also to terminal 1 of the digital readout and display 140. Terminal 13 of exclusive "OR" gate 134 is tied through a 100K ohm resistor 135 to regulated DC and to terminal "HI" of switch 142 of the double pole double throw type. Terminal 1 of exclusive "OR" gate 134 is connected to terminal 4 of digital readout and display 140. Terminal 1 of exclusive "OR" gate 138 is connected to terminal "LO" of switch 142 and also through a 100K ohm resistor 137 to regulated DC. Terminal 3 of exclusive "OR" gate 138 is connected to terminal number 8 of the digital readout and display 140. Terminal 6 of exclusive "OR" gate 136 is connected to terminal 9 of latch 120. Terminal 10 of exclusive "OR" gate 116 is connected to terminal number 38 of the digital readout and display 140. Terminal 4 of exclusive "OR" gate 136 is connected to terminal number 39 of the digital readout and display 140.

The output terminal 2 comparator 92 is connected to the reset terminals 14 of dividers 144 and 146.

Terminals 12 from both divider circuits 144 and 146 are also connected to the "X100" and "X10" terminals respectively of switch 24. Terminal 5 of divider 144 is also connected in parallel with terminal 12 of divider circuit 146 to the "X10" terminal of switch 124. The rotor 148 of switch 132 is connected to the "X" terminal of switch 124. The rotor 152 of switch 124 is connected to the "LO" terminal of switch 142. The rotor 158 of switch 132 is connected to the "X" terminal of switch 124. The rotor 160 of switch 124 is connected to terminal 3 of latch 162. Terminal 5 of latch 162 provides inputs to terminal 14 of divider circuits 164, 166, 130 and 168. This provides a clear pulse for these dividers. Terminals 2 and 4 of latch 162 are connected to the output of the regulated power supply. The latch or clock pulse output terminals 6 of latch 162 provides inputs to terminals 1 and 2 of shift register 128. The 100K Hertz clock 48 provides a clock pulse from terminal 11 into terminal 8 of the shift register 128 and to terminal 5 of divider circuit 164. The output from terminal 12 of divider circuit 168, is connected to the "HI" terminal of switch 142. Terminal 5 of divider 168 is also connected in parallel to the "LO" terminal of switch 142 and to the rotor 152 of switch 124. Terminal 5 of divider 166 and terminal 12 of divider 164 are tied in parallel to the "X1" terminal of switch 124. The rotor 158 of switch 132 is tied to the "X" terminal of switch 124. The "X10" terminal of switch 124 is tied to pin 5 of divider circuit 130 and to pin 12 of divider circuit 166. The rotor 169 of switch 142 is connected to terminal 32 of display counter 170.

The output from terminal 3 of shift register 128 provides a clear signal to terminal 1 of latch 162, also provides signals to terminals 34 and 31 of the display counter portion 170 of visual readout assembly 50. Terminal 5 of shift register 128 provides a reset pulse to terminal 33 of display counter 170. Terminal 29 of display counter 170 is tied to electrical ground potential. The output of display counter 170 provides the necessary inputs through line 172 to the digital readout and display 140 to operate the various segments of the digits.

All the resistors herein before mentioned are rated at a quarter watt plus or minus 5% tolerance, and the capacitors are of the 50 working volt DC type.

Operational amplifiers 60, 66 and 80 are individual segments of an integrated circuit LM324N manufactured by National Semi-Conductor Co. Comparators 92, 106 and 108 are individual segments of an integrated circuit LM3302N manufactured by National Semi-Conductor Co. Exclusive "OR" gates 116, 134, 136, and 138 are individual segments of an integrated circuit 74C86N manufactured by National Semi-Conductor Co. Latches 120 and 162 are individual segments of an integrated circuit 74C74N manufactured by National Semi-Conductor Co. The display counter 170 is an integrated circuit 1CM7224 IPL manufacted by Intersil Co. Counters 130, 144, 146, 164, 166 and 168 are integrated circuits 74C192N manufactured by National Semi-Conductor Co. Shift register 126 and 128 are integrated circuits 74C164N manufactured by National Semi-Conductor Co. The 100K Hertz Clock 48 is manufactured by Seiko. The voltage regulator module 88 is an integrated circuit LM78L05ACZ manufactured by National Semi-Conductor Co. The digital display 140 is a Liquid Crystal Display (LCD) manufactured by AND Corp.

Throughout the detailed circuit description various terminal numbers have been called out for ease of discussion. It should be understood that any equivalent integrated circuit or individual component may be substituted to practice the invention equally well and that various manufacturers will have different terminal numbers for electrically interchangeable components. Any person skilled in this art will be able to interchange various different components with different terminal numbers with ease while practicing this invention.

According to the various figs., the escapement excursions are detected by sensor 40. These mechanical noise signals are converted to electrical signals representative thereof. These electrical signals are amplified by operational amplifiers 60, 66, 80. The gain level between the output of amplifier 60 and input of amplifier 66 is adjustable by potentiometer 70. The output of amplifier 80 is provided with a connection for an audio monitoring means, such as head phones 44 or the like.

A regulated power supply 52 provides a regulated 5VDC when switch 98 is placed in the "on" position and the battery 86 has sufficient voltage. The output of comparator 92 provides a reset level to counters 144 and 146 when the power supply voltage drops below the level required for regulation. The output of comparator 108 supplies a reset level to shift register 126 etc., during a low voltage condition.

The regulated power supply output, upon turning on, initially resets counters 144, 146, shift registers 126, 128 and latches 120, 162.

Exclusive "OR" gate 134 provides a decimal point display indication after one significant digit when switch 142 is in its 38 LO" position and exclusive "OR" gate 138 provides a decimal point display indication after two significant digits when switch 142 is in its "HI" position. Exclusive "OR" gate 116 provides a low battery signal to the digital readout and display 140. Exclusive "OR" gate 136 provides voltage following each escapement pulse for activation of indicators 172 and 174 on the display readout 140.

When switch 124 is positioned in its "X1" position, the escapement pulses from latch 120 are fed directly into latch 162 and the time interval between each excursion is displayed on display 140 and 10K Hertz is supplied to terminal 32 of display counter 170 when switch 142 is in its "LO" position and 1K Hertz when switch 142 is in its "HI" position. When switch 124 is in its "X" position and switch 132 is in its "X10" position, the escapement pulse from latch 120 is divided by 10 to provide a ten count delay to latch 162 and with switch 142 in its "LO" position 1000 Hertz is present on terminal 32 of display counter 170 and with switch 142 moved to its "HI" position (switch 132 remaining on "10") 100 Hertz is supplied to terminal 32 of display counter 170. When switch 132 is positioned in its "X100" position, the escapement pulse from latch 120 is divided by 100 to provide a one hundred count delay to latch 162 and with switch 142 in its 37 LO" position 100 Hertz is present on terminal 32 of display counter 170 and with switch 142 moved to its "HI" position (switch 132 remaining on "X100") 10 Hertz is supplied to terminal 32 of display counter 170.

OPERATION OF THE PREFERRED EMBODIMENT

To operate the device, the sensor 40 is attached to the clock frame (not shown) in the vicinity of the escapement. Switch 98 is then placed in the "ON" position. The low battery indicator 172 will indicate for a fraction of a second if the battery condition is satisfactory, that is its output is sufficient to provide regulated power. As the battery discharges with use, the signal lights for longer intervals. If the signal fails to light, or if it fails to disappear, the battery condition is unsatisfactory.

The display 140 should indicate all zeroes with one decimal point after the first or second digit. Adjust the threshold level adjusting potentiometer 70 until two dots (172, 174) on the left side of the display 140 appear to blink on and off in time with the escapement cycle which is monitored by audio monitor means 44. If the dots do not appear with each beat, the threshold is set at too high a level. If they fail to disappear between beats, the threshold is set too low. If the dots appear with each beat and disappear between beats, the threshold is set properly.

Determine by calculation the correct time of each excursion cycle for proper timing. If the correct excursion time falls between 0.0000 and 1.9999 seconds, set switch 142 in the "LO" position. If the time falls between 1.9999 and 19.999, set switch 142 in the "HI" position. Set switch 124 to "X1" to measure the time intervals of each single beat. The asymmetry of the escapement cycle will appear as a high number alternating with a low number. Adjust the escapement cycle symmetry until the numbers become nearly equal. The escapement is now in beat. Now position switch 124 to "X" and switch 132 to either the "X10" or "X100" ensemble average position. After the beats have been counted, the display will show the average interval of the escapement cycle according to selected position of switch 132.

Figure 4:
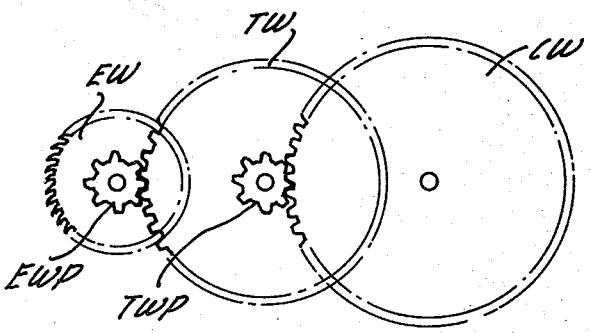
FIG. 4 is a schematic showing of an escapement having three wheels and two springs.

The calculation of the correct time required for one swing of a pendulum or balance wheel (excursion cycle) is well known in the clockmaker art and will not be explained in great detail. A typical example for determining the correct time for the escapement of a specific clock (a three wheel with two having leaves). In FIG. 4, C.W. (center wheel) equals 84 teeth, T.W. (third wheel) equals 80 teeth, E.W. (escape wheel) equals 40 teeth, T.W.P. (third wheel pinion) equals 8 leaves and E.W.P. (escape wheel pinion) equals 8 leaves. Calculate as follows:

$$\frac{(84) \times (80) \times (40) \times (2)}{(8) \times (8)} = \frac{537{,}600}{64} =$$

$$8400 \text{ swings per hour or } \frac{3600 \text{ sec per hr}}{8400 \text{ swings per hr}} =$$

.4285714 seconds per swing rounded off to 0.4286.

Although the foregoing invention has been described in some detail by way of illustration and example, for the purpose of clarity of understanding, it should be understood that certain changes and modifications may be practiced within the spirit of the invention as limited only by the scope of the appended claims.

What is claimed as new and useful and desired to be secured by United States Letters Patent is:

1. A clock escapement monitoring device comprising:

a sensor means for detecting the mechanical vibrations occurring at each excursion of said clock escapement and producing an electrical signal corresponding to said vibration;

amplifier means for amplifying said electrical signal to a desired level;

a standard time signal;

circuit means utilizing said standard time signal for counting consecutive amplified electrical signals, said circuit means selectively capable of producing a visual display signal representing the time interval of one escapement excursion cycle, the average time of each excursion cycle during ten successive excursion cycles and the average time of each excursion cycle during one hundred successive excursion cycles;

a display means for visually displaying said visual display signal; and power supply means for supplying operating power to said clock escapement monitoring device.

2. The invention as defined in claim 1 wherein said sensor means is a piezoelectric device.

3. The invention as defined in claim 1 wherein said sensor means is an electromechanical transducer.

4. The invention as defined in claim 1 wherein the standard time signal has a frequency of 100K Hertz.

5. The invention as defined in claim 1 wherein said amplifier means includes input signal level adjustment means.

6. The invention as defined in claim 1 wherein said amplifier means includes an audio monitoring means.

7. The invention as defined in claim 1 wherein said display means comprises a liquid crystal display.

8. The invention as defined in claim 1 wherein the output of said supply is a regulated 5 volt DC.

9. The invention as defined in claim 1 further comprising means for detecting and visually displaying power supply voltage level below a predetermined value.

10. A method of correctly adjusting the escapement mechanism of a clock utilizing same comprising the steps of:

(a) sensing the mechanical vibrations occurring at each excursion of said escapement mechanism;

(b) converting the sensed mechanical vibrations into electrical signals representative thereof;

(c) providing a standard time signal;

(d) utilizing said standard time signal for counting consecutive amplified electrical signals and selectively producing visual display signals representative of the average length of time between at least two consecutive electrical signals, the average time of each excursion cycle during ten successive excursion cycles and the average time of each excursion cycle during one hundred successive excursion cycles;

(e) comparing the visual display selected with a known correct length of time between consecutive electrical signals and adjusting said escapement mechanism until said visual display signal is substantially equal to said known correct length of time.

11. The method of claim 10 including an additional step of listening to the amplified electrical signal to determine the correct mechanical tolerance of said escapement mechanism.

* * * * *